US007883087B2

(12) United States Patent
Kitano

(10) Patent No.: US 7,883,087 B2
(45) Date of Patent: Feb. 8, 2011

(54) IMAGE FORMING APPARATUS

(75) Inventor: Isao Kitano, Tokyo (JP)

(73) Assignee: Oki Data Corporation, Tokyo (JP)

( * ) Notice: Subject to any disclaimer, the term of this patent is extended or adjusted under 35 U.S.C. 154(b) by 410 days.

(21) Appl. No.: 11/047,421

(22) Filed: Jan. 31, 2005

(65) Prior Publication Data

US 2005/0184442 A1 Aug. 25, 2005

(30) Foreign Application Priority Data

Feb. 3, 2004 (JP) ..... 2004-026205

(51) Int. Cl.
*B65H 7/02* (2006.01)

(52) U.S. Cl. ..... 271/258.01; 271/259; 271/258.02; 271/256

(58) Field of Classification Search ..... 271/258.01, 271/259, 258.02, 264, 291, 3.03, 265.01, 271/265.02, 256; 399/401, 364
See application file for complete search history.

(56) References Cited

U.S. PATENT DOCUMENTS 4,231,567 A * 11/1980 Ziehm ..... 271/259
4,275,879 A * 6/1981 Yamashita et al. ..... 271/259
4,627,711 A * 12/1986 Schron ..... 399/20
4,786,041 A * 11/1988 Acquaviva et al. ..... 271/3.13
5,030,991 A * 7/1991 Zaitsu et al. ..... 399/20
5,328,168 A * 7/1994 Fox ..... 271/259
5,393,043 A * 2/1995 Nitta ..... 271/9.06
5,424,821 A * 6/1995 Sampath ..... 399/45
5,678,123 A * 10/1997 Kim ..... 399/21
5,678,138 A * 10/1997 Kobayashi et al. ..... 399/18
6,010,127 A * 1/2000 DiCesare et al. ..... 271/259
6,145,828 A * 11/2000 Arai ..... 271/3.03
6,185,381 B1 * 2/2001 Nakahara et al. ..... 399/21
6,340,157 B1 * 1/2002 Watanabe et al. ..... 271/301
6,557,849 B2 * 5/2003 Wyss ..... 271/259
6,959,155 B2 * 10/2005 Kim ..... 399/21
2002/0074720 A1 * 6/2002 Kato et al. ..... 271/264
2004/0022565 A1 * 2/2004 Tomono et al. ..... 399/401
2006/0006594 A1 * 1/2006 Kuru et al. ..... 271/258.02

FOREIGN PATENT DOCUMENTS

JP 11-208962 A 8/1999

* cited by examiner

*Primary Examiner*—Stefanos Karmis
*Assistant Examiner*—Prasad V Gokhale
(74) *Attorney, Agent, or Firm*—Panitch Schwarze Belisario & Nadel LLP

(57) ABSTRACT

An image forming apparatus includes a judging unit for judging as to whether paper jamming occurs in the medium feeding unit at a time that the paper jamming occurs in the medium conveyance route and a controller for controlling the medium positioned on an upstream side of the medium feeding unit to be conveyed into the medium feeding unit when judging that no paper jamming occurs in the medium feeding unit, to allow the feeding unit detaching from the apparatus body without tearing or breaking the jammed paper.

8 Claims, 16 Drawing Sheets

IMAGE FORMING APPARATUS

BACKGROUND OF THE INVENTION

1. Field of the Invention

This invention relates to an image forming apparatus such as, e.g., a printer or photocopier and, more particularly, to an image forming apparatus forming a portion of a medium conveyance route and having a unit detachably attached to an apparatus housing or a unit that can be drawn from the apparatus housing.

2. Description of Related Art

Image forming apparatuses have been disclosed in which images are formed as paper is fed sheet by sheet successively and the paper side is reversed to make the double side of the paper printed. With such an apparatus, to print plural pages, the paper is sequentially and successively supplied, and images are formed on the respective papers as the papers are conveyed parallel in the respective conveyance routes to deliver the paper completed with image formation is delivered at a delivery portion, see, e.g., Japanese Unexamined Patent Publication No. Heisei 11-208,962.

With such an image forming apparatus, paper feeding operation and printing operation are immediately stopped upon recognition of paper jamming occurrences, when plural sensors arranged in the respective conveyance routes detect occurrences of, e.g., feeding defects and doubly feeding, or namely, when paper is not fed for a prescribed period or when the apparatus detects existence of a paper at a certain place for a prescribed period. For example, paper may occasionally stop astride a conveyance route and a reverse conveyance unit during execution of double side printing. If the reverse conveyance unit is drawn out of the apparatus body to remove the jammed paper in such a situation, the paper may be tom or broken up, thereby rending paper removing work laborious and complicated, and thereby raising problems such that it forces delayed recovery and needs a long time to restart printing.

SUMMARY OF THE INVENTION

It is an object of the invention to provide an image forming apparatus in which a detachable medium feeding unit can be drawn out of an image forming apparatus body without tearing or breaking a jammed medium in a case where the jammed medium is located astride the image forming apparatus body and the medium feeding unit on an upstream side of the medium feeding unit.

In accordance with the invention, an image forming apparatus for forming an image on a medium includes: a medium feeding unit forming a part of a medium conveyance route and having a structure detachably attached to an apparatus body; a judging unit for judging as to whether paper jamming occurs in the medium feeding unit at a time that the paper jamming occurs in the medium conveyance route; and a controller for controlling the medium positioned on an upstream side of the medium feeding unit to be conveyed into the medium feeding unit when the judging unit judges that no paper jamming occurs in the medium feeding unit.

With this structure of the invention, the medium is conveyed into the interior of the medium conveyance unit detachably attached to the apparatus body, when the medium is positioned on the upstream of the medium conveyance unit astride the apparatus body and the medium conveyance unit, so that the medium conveyance unit can be detachably drawn out of the image forming apparatus body without tearing or breaking the jammed paper, and so that other media remaining in the image forming apparatus body can be removed easily.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

DETAILED DESCRIPTION OF THE PREFERRED EMBODIMENTS

Figure 1:
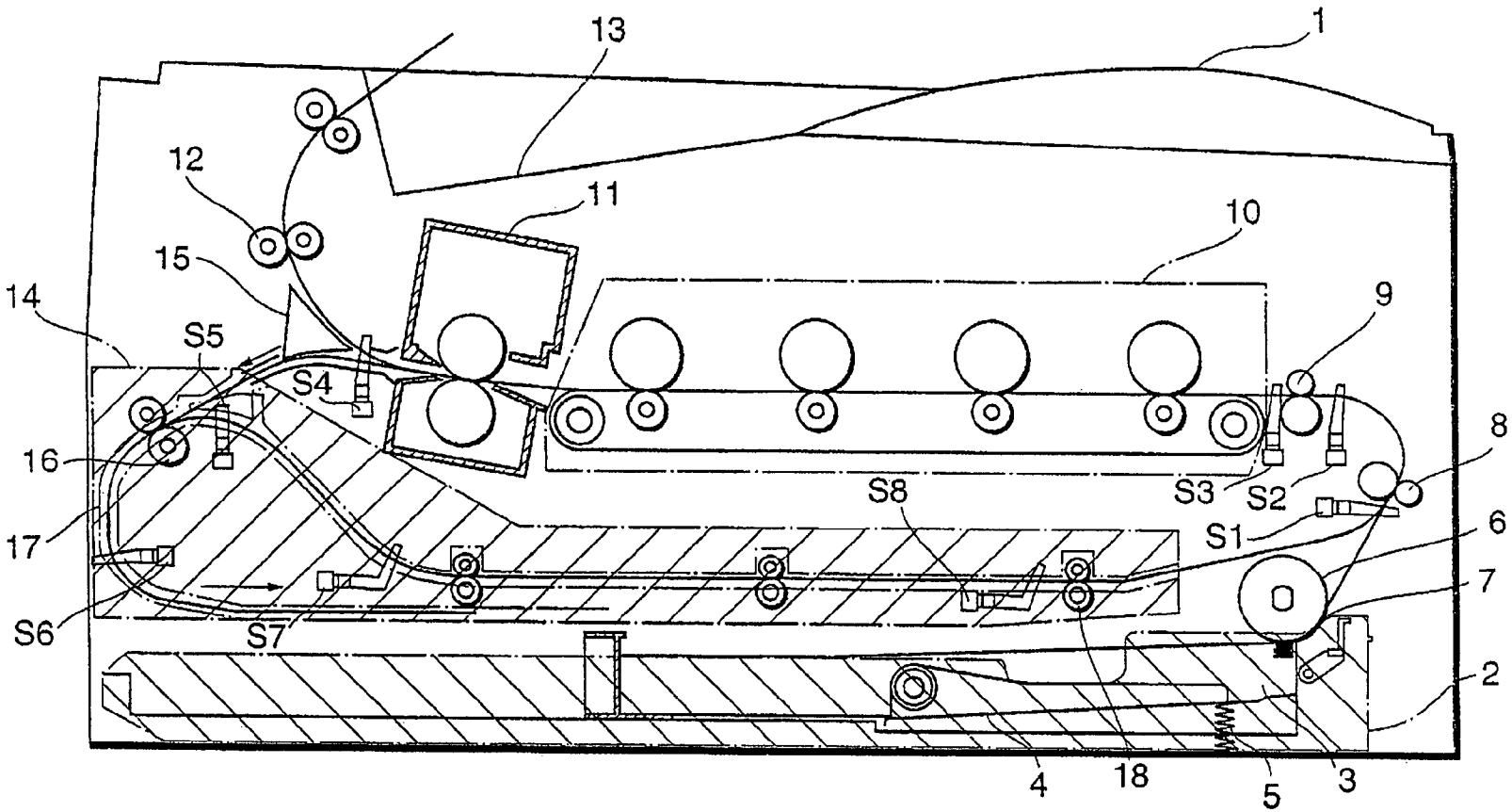
FIG. 1 is a cross-sectional diagram showing a structure of an image forming apparatus according to the first embodiment of the invention.

Referring to the drawings, preferred embodiments according to the invention are described. In the drawings, the same reference numbers among the embodiments are assigned for common elements of the apparatuses.

FIG. 1 to FIG. 6 illustrate an image forming apparatus according to the first embodiment of the invention; FIG. 1 shows a structure of an image forming apparatus according to the first embodiment of the invention. It is to be noted that the image forming apparatus can be any of a printer, a photocopier, a facsimile machine, and a complex machine having multiple functions of those.

As shown in FIG. 1, a paper container 2 for containing paper (hereinafter referred to as "paper cassette 2") is detachably attached to an apparatus body 1 of the image forming apparatus. The paper cassette 2 is provided with a paper up and down stage 4 (hereinafter referred to as "sheet plate 4"), a spring 5 as a means for moving up and down the sheet plate 4, and a separation piece 7 for separating paper.

A feeding roller 6 is arranged on a paper in the paper cassette 2 for feeding paper. The drive shaft of the feeding roller 6 is connected to a feeding motor 101 controlled by a controller 100. A register roller 8 and a conveyance roller 9 are arranged above the feeding roller 6 to make correction against oblique feeding of the paper. The register roller 8 and the conveyance roller 9 constitute an inlet portion of a paper conveyance route serving as a medium conveyance route. The drive shafts of the register roller 8 and the conveyance roller 9 are coupled to a register motor 102 controlled by the controller 100.

An image forming section 10 for forming images on the paper and a fixing section 11 for fixing toner transferred on the paper are arranged at the apparatus body 1. The drive shafts of a belt drive roller of the image forming section 10 and a fixing roller of the fixing section 11 are coupled to a belt motor 103 and a fixing motor 104, respectively, controlled by the controller 100. A delivery roller 12 is disposed on a downstream side of the fixing section 11 and constitutes a delivery portion of the conveyance route. A delivery tray 13 is formed at a top of the apparatus body 1, to which paper with printed double sides thereof is delivered.

A conveyance switching guide 15 is disposed at the apparatus body 1 between the fixing section 11 and the delivery roller 12. The conveyance switching guide 15 switches the paper conveyance route according to a switching solenoid 106 controlled by the controller 100. The paper can be introduced selectively to either of the delivery roller 12 and the reverse conveyance unit 14 by switching the paper conveyance route.

A roller 16 rotatable in the normal and reverse directions (hereinafter referred to as "reverse roller") with respect to the conveyance route 17 is arranged at the reverse conveyance unit 14. A re-feeding roller 18 is provided for conveying the paper located in the reverse conveyance unit 14 to the register roller 8 again. The drive shafts of the reverse roller 16 and the re-feeding roller 18 are coupled to a reverse motor 105 controlled by the controller 100. The re-feeding roller 18 is structured to rotate always in a fixed direction even where the reverse motor 105 rotates in normal and reverse directions.

As shown in FIG. 1, plural paper detection sensors are arranged at the paper conveyance route formed of the apparatus body 1 and the medium feeding unit, or namely the reverse conveyance unit 14. Three paper detection sensors (S1 to S3) are disposed at an entrance of the paper conveyance route; paper introduction sensors S1, S2 are arranged above the paper cassette 2 for detecting paper's introduced state in the conveyance route; a writing sensor S3 is provided immediately before the image forming section 10 for detecting paper's arrival to the image forming section 10. A delivery sensor S4 is provided on a downstream side of the fixing section 10 to detect a delivery state of paper on the surface of which image are formed and fixed, and four paper sensors S5 to S8 are disposed in the reverse conveyance unit 14. Reverse sensors (S5 to S7) detecting paper's reverse conveyance state in the reverse conveyance unit 14, a reverse feeding sensor S8 detecting a re-feeding state of the paper fed to the apparatus body from the reverse conveyance unit 14, are disposed near the outlet. Upon receptions of the detecting signals from the plural paper detection sensors S1 to S8, the controller 100 can recognize states that the paper cannot be conveyed in a prescribed time or that the paper is stagnated at the same place beyond a prescribed time.

In operation of the image forming apparatus according to the first embodiment, with reference to FIG. 1 to FIG. 6, first, the paper 3 set on the sheet plate 4 in the paper cassette 2 is lifted by the spring 5 up until that the top surface of the topmost paper of the paper stacked comes in contact with the feeding roller 6. The feeding roller 6 is driven to rotate in a counterclockwise direction in association with a drive system formed of the feeding motor 101 and gears, not shown. The topmost paper of the stacked sheets is fed in a right direction in FIG. 1 with frictional force of the feeding roller 6 according to the rotation of the feeding roller 6. The separation piece 7 is formed as a prevention means for preventing the sheets of two or more from being pulled by the rotation of the feeding roller. The frictional force of the immobilized separation piece 7 prevents plural sheets of paper from being pulled at the same time, thereby separating the paper sheet by sheet and feeding the paper.

In the apparatus body 1, the paper fed out of the paper cassette 2 by the feeding roller 6 is conveyed to the register roller 8 located at the inlet of the conveyance route. The paper's oblique feeding if any is corrected by the register roller 8, and the paper is conveyed to the image forming section 10 via the conveyance roller 9. Images are formed on the paper at the image forming section 10, and the images are fixed through the fixing section 11. The paper is then conveyed to the reverse roller 16 in the reverse conveyance unit 14 by the conveyance switching guide 15. When the reverse conveyance sensor S5 detects the passage of the rear end of the paper, drive of the reverse roller 16 is stopped, thereby temporarily stopping the paper. Subsequently, the reverse roller 16 is rotated reverse by reverse rotation of the reverse conveyance motor 105, thereby switching the conveyance route to a direction different from the direction that the paper is conveyed, and thereby conveying the paper to the re-feeding roller 18. While the paper is conveyed in the reverse conveyance unit 14, a subsequent paper is conveyed out of the paper cassette 2. By repeating the above steps, the paper is fed from the paper cassette 2 to the reverse conveyance unit 14.

The paper fed by the re-feeding roller 18 in the reverse conveyance unit 14 is conveyed to the register roller 8 in the apparatus body 1 as the surface on which images are formed faces to the lower side. Subsequent image formation and fixing operation is done in substantially the same manner as that of image formation for paper surface, and a duplicated description is omitted herein. After images are formed on the backside of the paper, the paper with the double side on which images are printed is conveyed to the delivery roller 12 via the conveyance switching guide 15 and delivered to the delivery tray 13.

Figure 2:
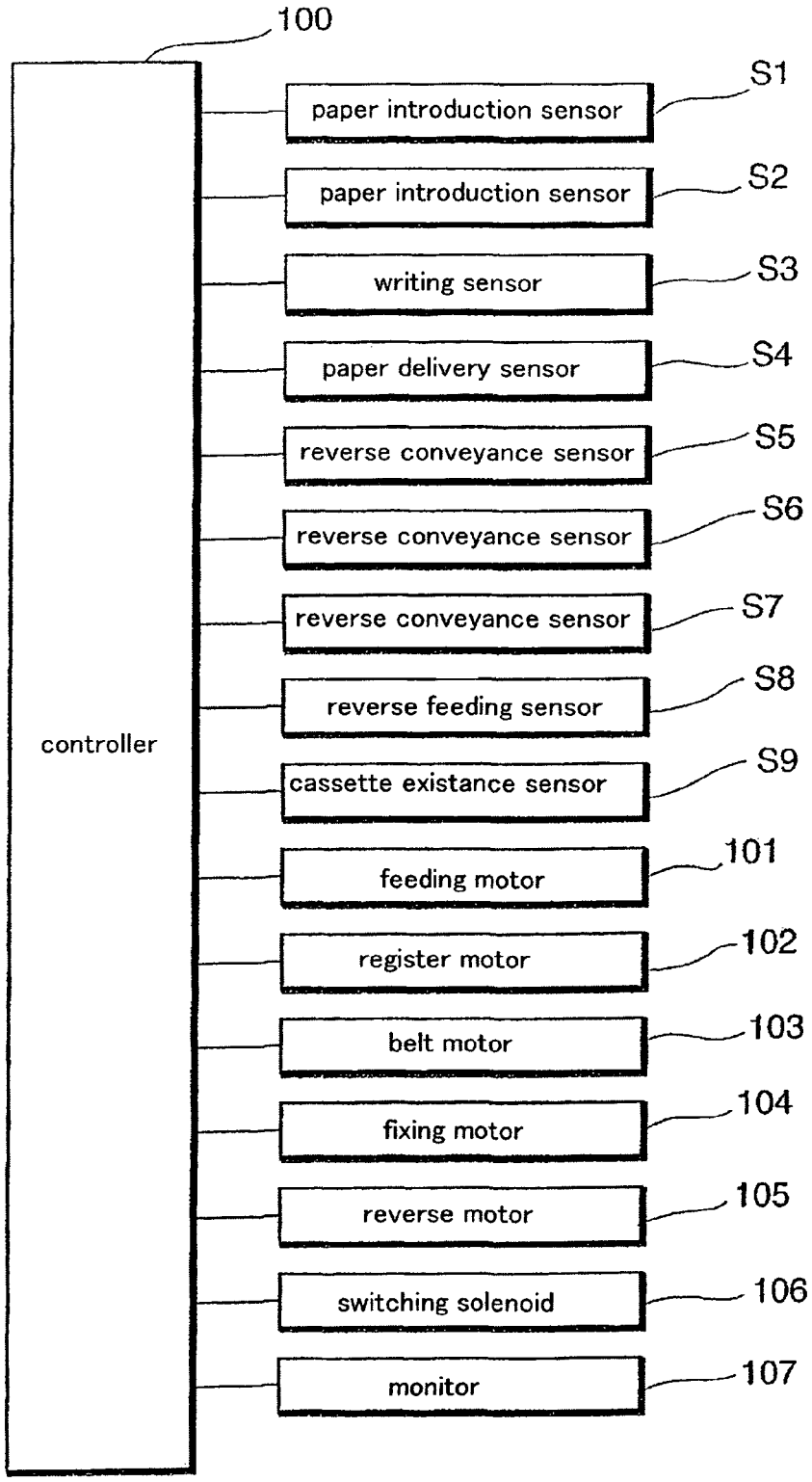
FIG. 2 is a block diagram showing a control system of the image forming apparatus according to the first embodiment.

FIG. 2 is a block diagram showing a control system of the image forming apparatus according to the first embodiment. The controller 100 is for controlling operation of the image forming apparatus and is formed of a CPU, and so on. In the image forming apparatus of the first embodiment, plural paper detection sensors (S1 to S8) are provided in the conveyance route for conveying papers. The plural paper detection sensors detect the status of the paper's feeding and transmit detection signals to the controller 100. The controller 100 receives the detection signals from the plural paper detection sensors (S1 to S8) and temporarily stops the paper conveyance and printing operation upon a judgment that paper jamming occurs when the paper is not conveyed for a prescribed period or when the paper is stagnated at the same place for a prescribed period or more, thereby conveying the paper stopping astride the apparatus body 1 and the reverse conveyance unit 14 to the reverse conveyance unit 14 upon confirming that the paper jamming does not occur in the reverse conveyance unit 14.

Figure 3:
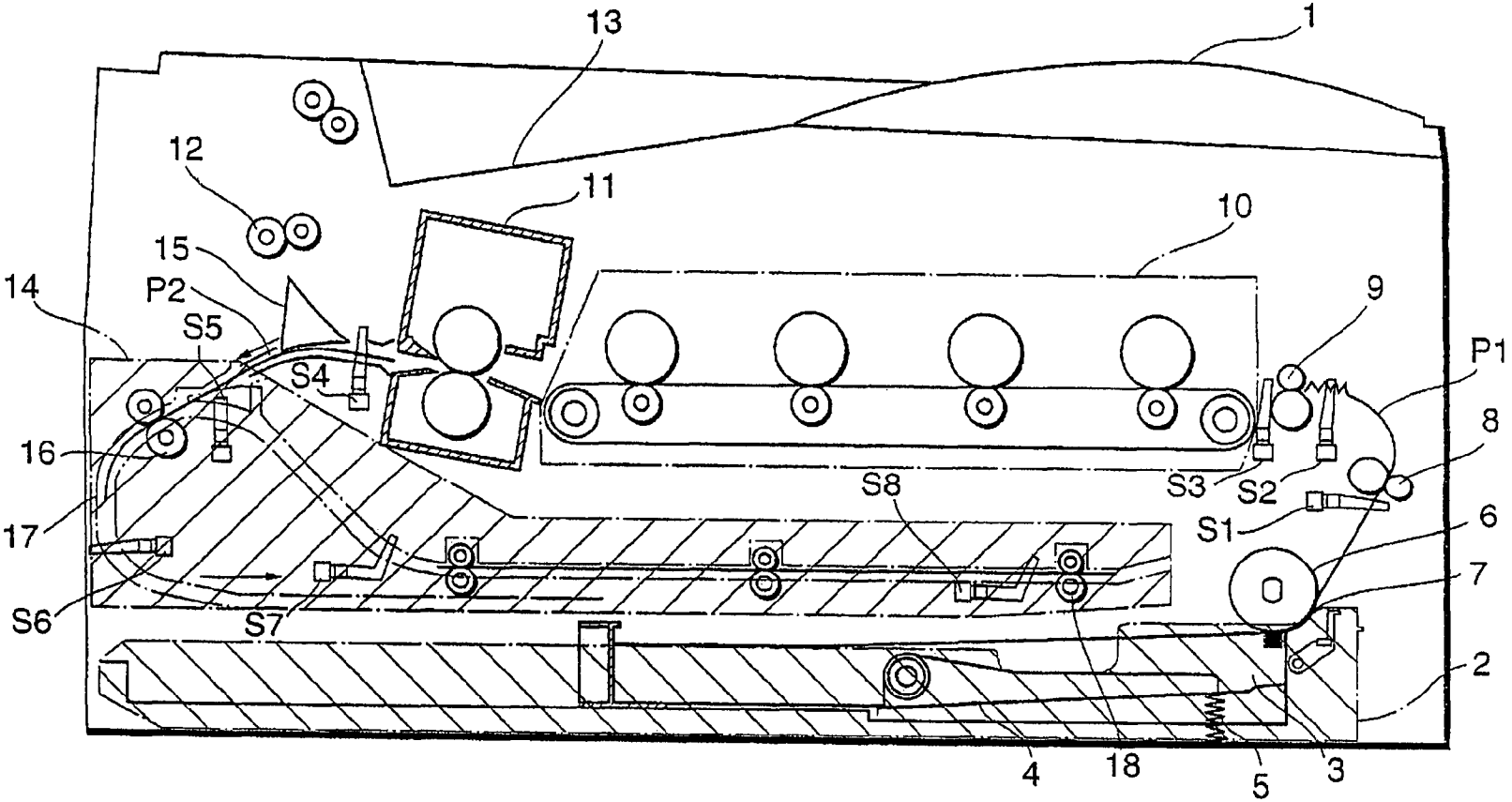
FIG. 3 is a cross-sectional diagram showing a structure of the image forming apparatus in a situation in which a medium is stopped astride the image forming apparatus body and the medium feeding unit at an occurrence of paper jamming.
Figure 4:
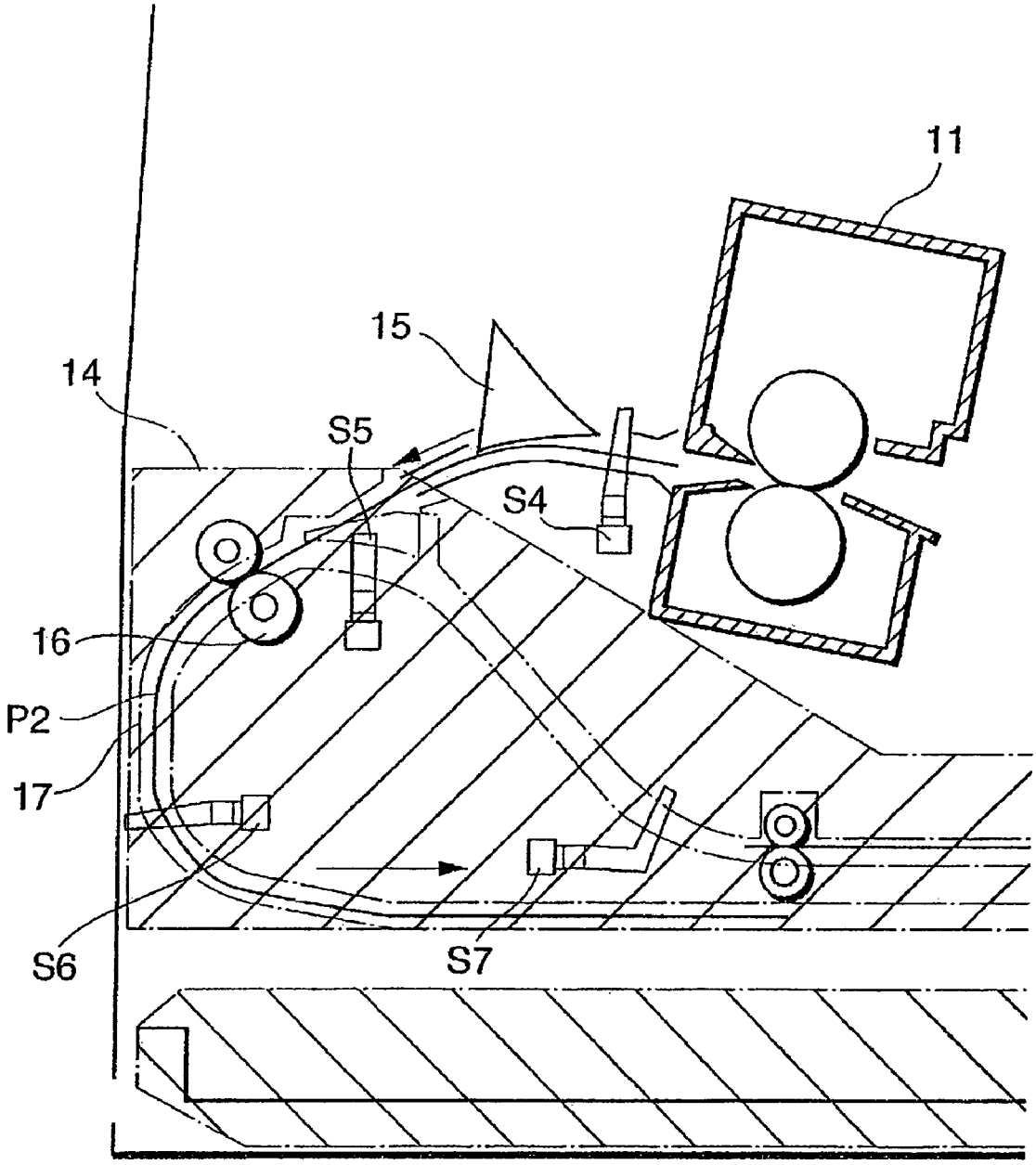
FIG. 4 is an illustration showing an essential portion of the image forming apparatus according to the first embodiment.

FIG. 3 is an illustration in a situation in which a paper P1 causes jamming, and proceeding paper P2 is stopped astride the fixing section 11 of the apparatus body and the reverse feeding unit 14 detachably attached to the apparatus body.

For example, where the paper detection sensors detecting that the paper jamming occurs are any one or more of the two paper introduction sensors S1, S2 and the writing sensor S3 and where either the paper delivery sensor S4 or the reverse conveyance sensor S5 detects the existence of the paper, the controller 100 judges not that paper jamming occurs in the reverse conveyance unit 14 but that the paper is remaining as located astride the apparatus body 1 on the upstream of the reverse conveyance unit 14. The controller 100 generates, based on the judgment, an instruction to drive the roller in the fixing unit 11 and the reverse roller 16 in the reverse conveyance unit 14, thereby moving the remaining paper P2 until that both of the paper delivery sensor S4 and the reverse conveyance sensor S5 detect that no paper exists. That is, the paper P2 is moved to the position shown in FIG. 4, and is loaded in the reverse conveyance unit 14.

A monitor 107 at that time displays that the paper P2 remaining on the upstream side of the reverse conveyance unit 14 in the image forming apparatus is loaded in the reverse conveyance unit 14 and that the paper jamming occurs.

Figure 5:
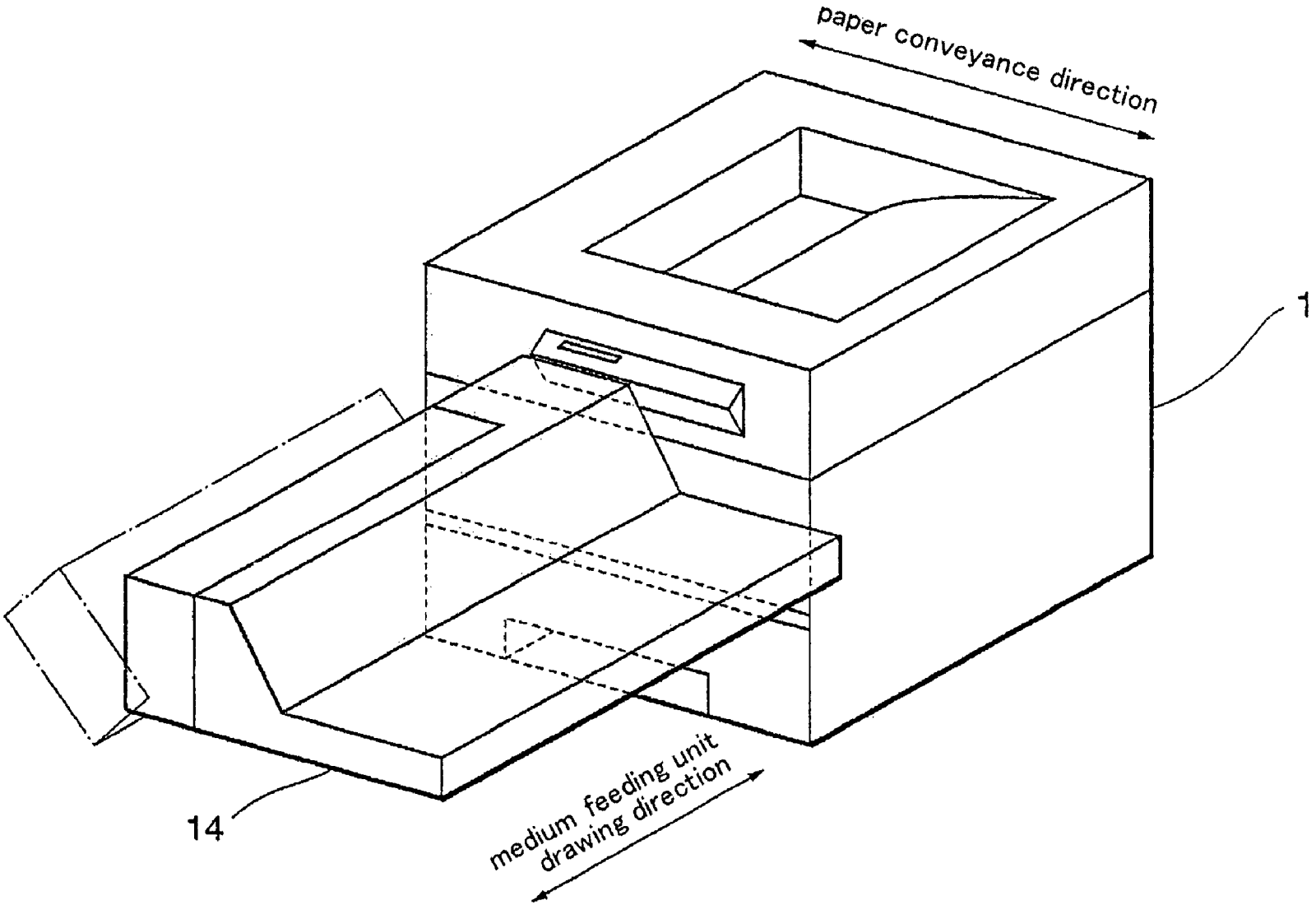
FIG. 5 is a diagram showing a state that the medium feeding unit is drawn.
Figure 6:
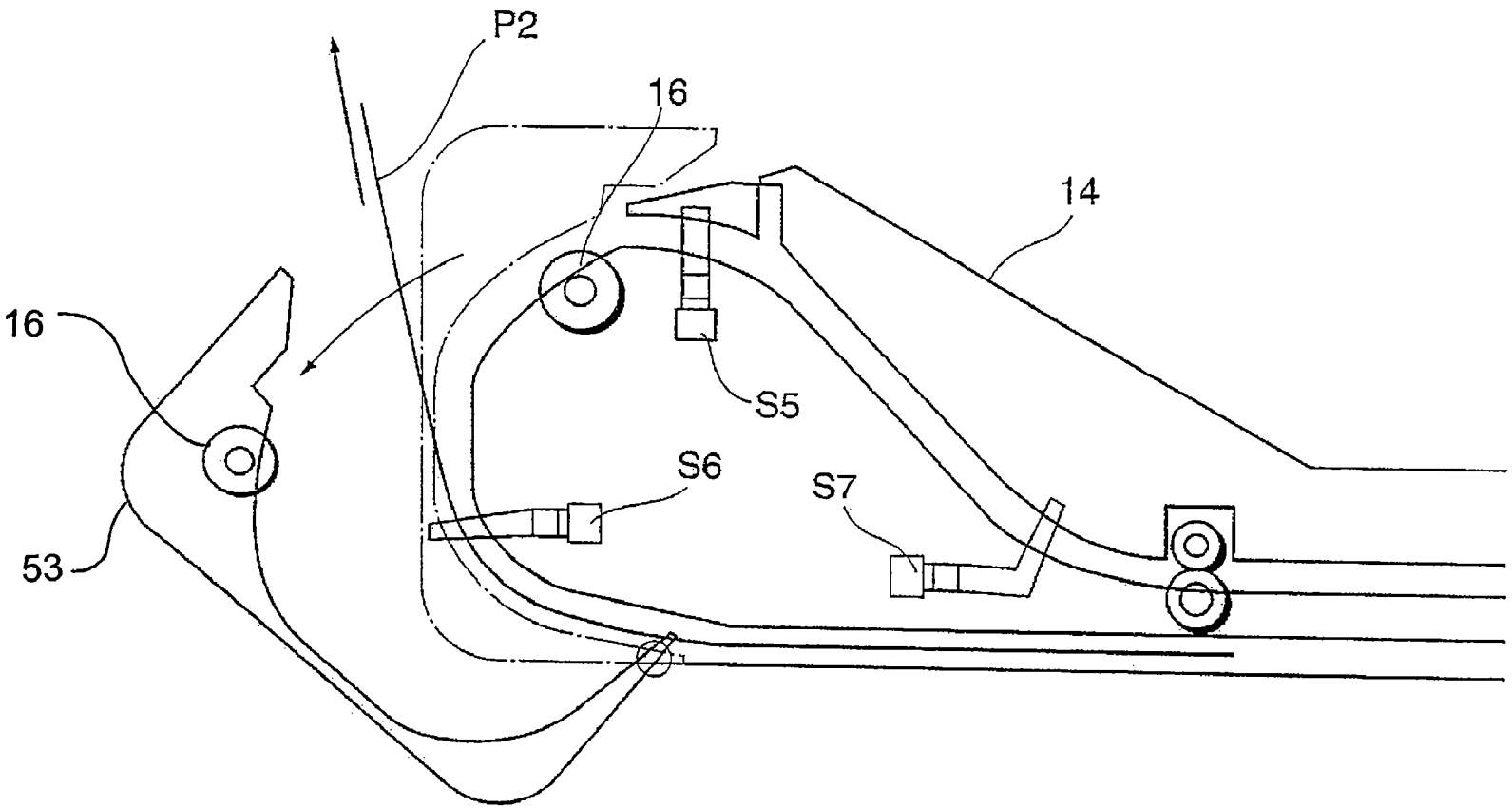
FIG. 6 is an illustration showing the essential portion of the image forming apparatus at a time that a remaining paper is removed.

An operator, upon viewing displayed contents, pulls out the reverse conveyance unit 14 from the apparatus body 1, opens the cover 53, and removes the remaining paper P2 (see, FIG. 5 and FIG. 6). The reverse conveyance unit 14 is thereafter inserted into the apparatus body 1, and the apparatus resumes printing operation, which is interrupted due to the occurrence of paper jamming, where the reverse conveyance sensor S6 detects no paper exists.

With the structure of the first embodiment, the stopped paper is conveyed into the reverse conveyance unit 14 when the paper located around the upstream of the reverse conveyance unit 14 is stopped astride the apparatus body 1 and the reverse conveyance unit 14 during occurrences of paper jamming, so that the reverse conveyance unit 14 can be pulled out of the apparatus body 1 without causing any tear on the paper, and so that other remaining paper in the image forming apparatus can be removed easily to render the remaining printing operation restart.

Figure 7:
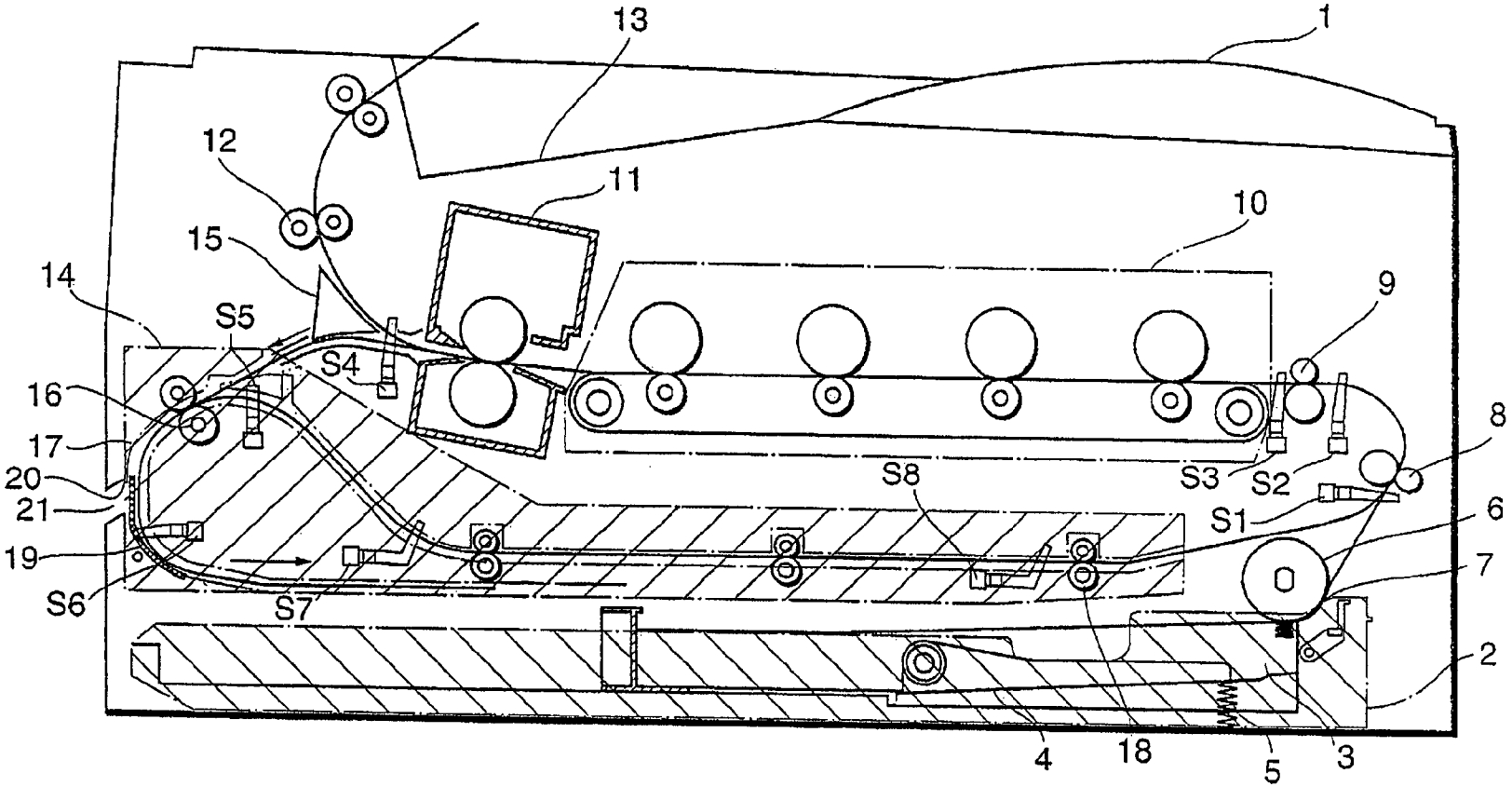
FIG. 7 is a cross-sectional diagram showing a structure of an image forming apparatus according to the second embodiment of the invention.

Referring to FIG. 7 to FIG. 10, an image forming apparatus according to the second embodiment of the invention is described in detail. FIG. 7 is a cross-sectional diagram showing a structure of an image forming apparatus according to the second embodiment of the invention.

As shown in FIG. 7, a conveyance switching guide 19 and a delivery route 20 are provided at a reverse conveyance route 17 in the reverse conveyance unit 14. The conveyance switching guide 19 switches the conveyance route of the paper. The conveyance switching guide 19 does switching operation with force of a reverse solenoid 108 controlled and driven by the controller 100. The delivery route 20 is used when the paper is delivered out of the reverse conveyance unit 14. A delivery outlet 21 is formed at the apparatus body 1 to deliver the paper out of the image forming apparatus. Other structures are substantially the same as those in the first embodiment.

Figure 8:
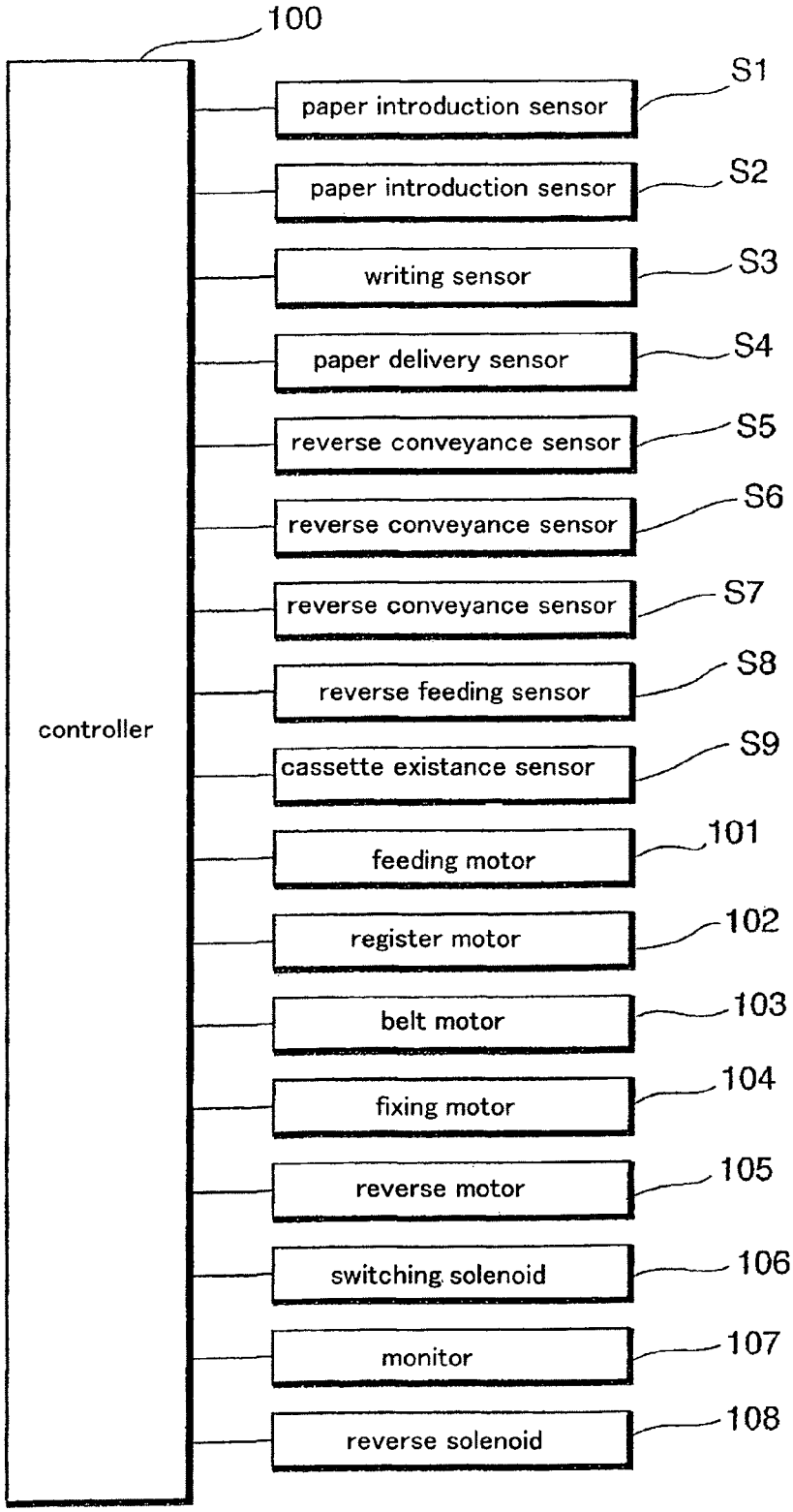
FIG. 8 is a block diagram showing a control system of the image forming apparatus according to the second, the third, and the forth embodiments.

FIG. 8 is a block diagram showing a control system of the image forming apparatus according to the second embodiment. Where the paper detection sensors detecting that the paper jamming occurs are any one or more of the two paper introduction sensors S1, S2 and the writing sensor S3 and where either the paper delivery sensor S4 or the reverse conveyance sensor S5 detects the existence of the paper, the controller 100 judges not that paper jamming occurs in the reverse conveyance unit 14 but that the paper is remaining as located on the upstream of the reverse conveyance unit 14.

Where the reverse conveyance sensor S6 disposed at the reverse conveyance unit 14 detects that no paper exists, the controller 100 judges that the front end of the paper P2 remaining on the upstream side of the reverse conveyance unit 14 does not reach the location of the reverse conveyance sensor S6. As a result of this judgment, the controller 100 switches the conveyance switching guide 19 toward the delivery route 20, or an arrow direction in FIG. 7, by the reverse solenoid 108 and the like (see, FIG. 10).

The remaining paper P2 is moved by drive of the roller in the fixing section 11 and the reverse roller 16 in the reverse conveyance unit 14 until that both of the paper delivery sensor S4 and the reverse conveyance sensor S5 detect that no paper exists. The remaining paper P2 in the image forming apparatus is conveyed to the reverse conveyance unit 14 and is delivered from the reverse conveyance unit 14 to the delivery route 20 by the conveyance switching guide 19. The remaining paper P2 is delivered from the delivery outlet 21 formed at the apparatus body 1 to the exterior of the image forming apparatus. The monitor 107 at the same time displays that the remaining paper is removed to notify the message to the operator.

Figure 9:
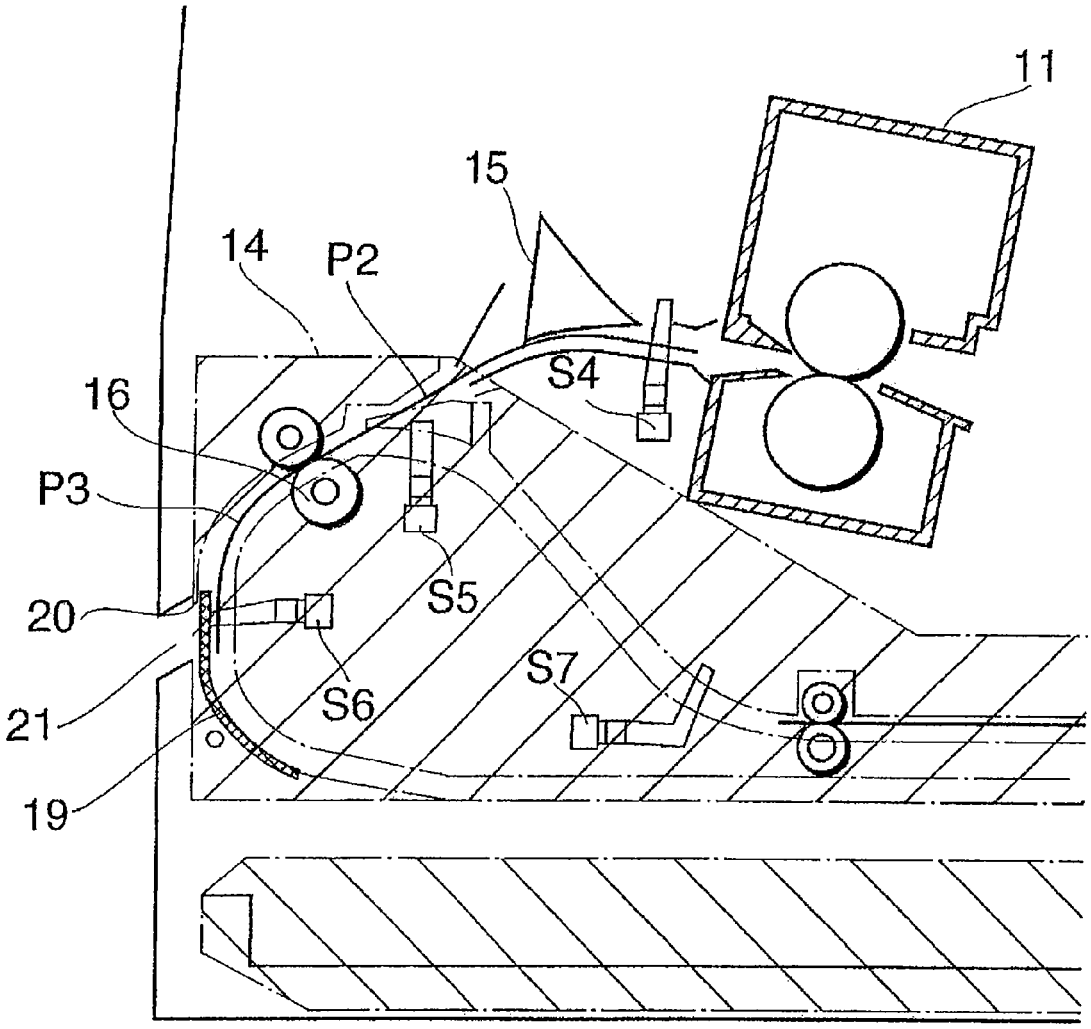
FIG. 9 is an illustration showing an essential portion of the image forming apparatus according to the second embodiment.
Figure 10:
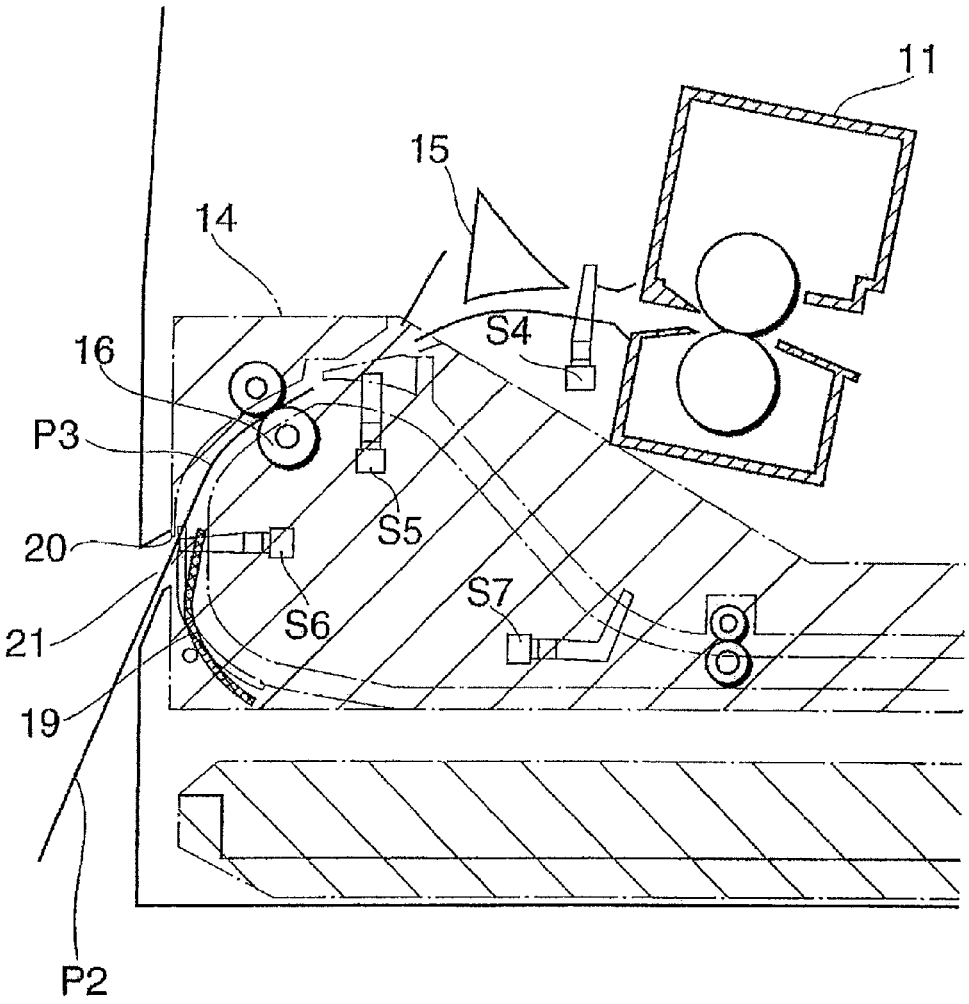
FIG. 10 is an illustration showing the essential portion of the image forming apparatus according to the second embodiment.

As shown in FIG. 9, where the controller 100 judges that the remaining paper P2 exists and where the reverse conveyance sensor S6 in the reverse conveyance unit 14 detects that the paper exists, only the reverse roller 16 in the reverse conveyance unit is rotated reverse to return the paper. The paper is temporarily contained as being loosen in a relatively wide conveyance route provided between the switching guide 15 and the reverse roller 16. The paper is returned, and the conveyance switching guide 19 is switched toward the delivery route 20 by the reverse solenoid 108, until that the reverse conveyance sensor S6 detects the situation that no paper exists (see, FIG. 10). The operation to deliver the paper P2 out of the image forming apparatus is substantially the same as the operation described above.

With the structure of the second embodiment, by proving conveyance switching guide 19 in the reverse conveyance unit 14, the stopped paper is conveyed into the reverse conveyance unit 14 when the paper located on the upstream side of the reverse conveyance unit 14 is stopped astride the apparatus body 1 and the reverse conveyance unit 14 during occurrences of paper jamming, so that the stopped paper can be removed away out of the image forming apparatus. Consequently, the paper remaining on the upstream side of the reverse conveyance unit 14 in the image forming apparatus can be can be easily removed away out of the image forming apparatus even without pulling the reverse conveyance unit 14 out of the apparatus body 1.

Figure 11:
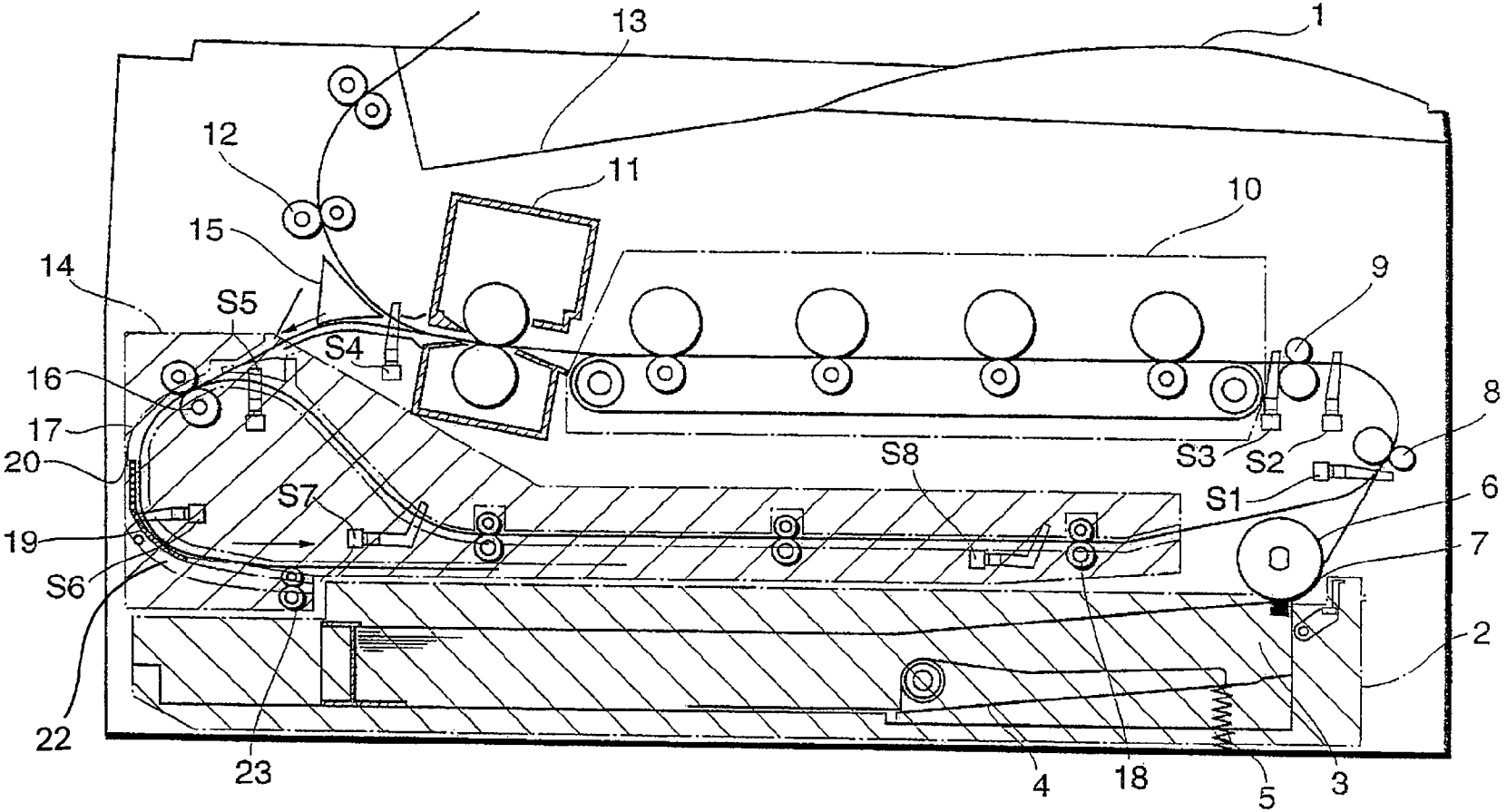
FIG. 11 is a cross-sectional diagram showing a structure of an image forming apparatus according to the third embodiment of the invention.
Figure 12:
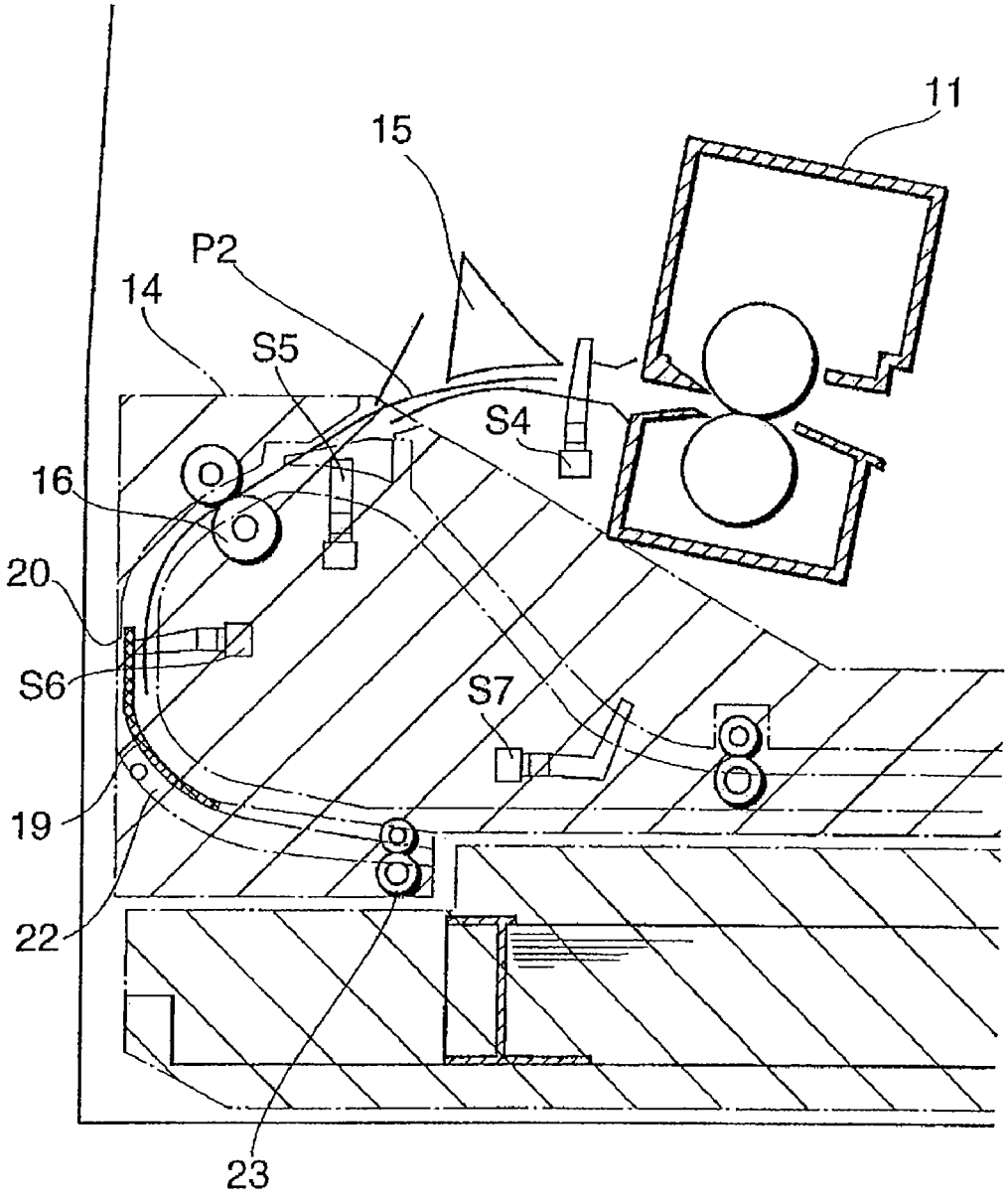
FIG. 12 is an illustration showing an essential portion of the image forming apparatus according to the third embodiment.
Figure 13:
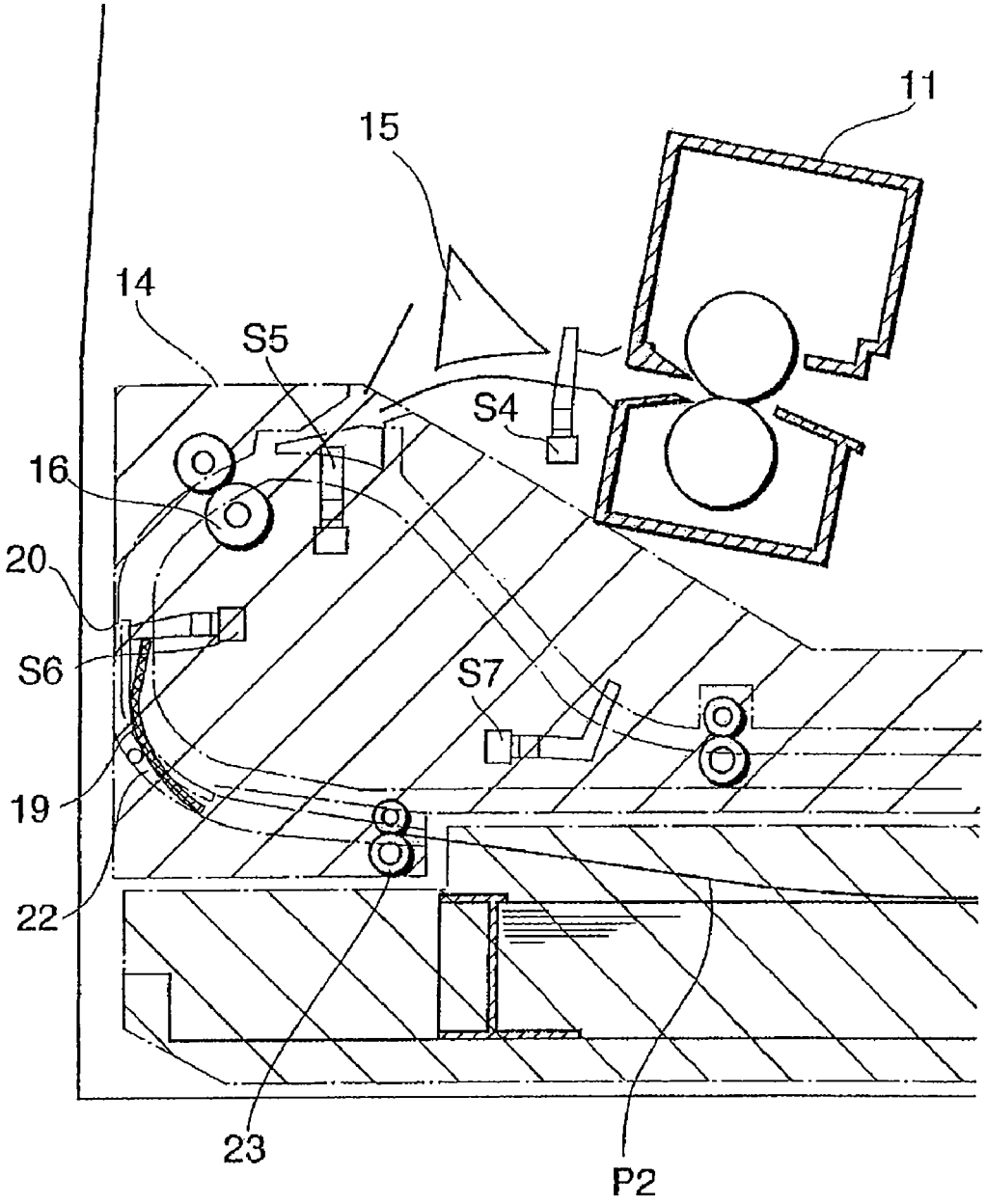
FIG. 13 is an illustration showing the essential portion of the image forming apparatus according to the third embodiment.

Referring to FIG. 11 to FIG. 13, an image forming apparatus according to the third embodiment of the invention is described in detail. FIG. 11 is a cross-sectional diagram showing a structure of an image forming apparatus according to the third embodiment of the invention.

As shown in FIG. 11, in the image forming apparatus according to the third embodiment, a conveyance switching guide 19 is formed at the conveyance route 17 in the reverse conveyance unit 14, and a conveyance route 22 is arranged to convey the paper to the paper cassette 2 disposed below the reverse conveyance unit 14. A conveyance roller 23 for conveying paper is provided at the conveyance route 22. The conveyance roller 23 is coupled to the reverse motor 105 via gears, not shown. The apparatus body 1 is formed with a cassette existence sensor S9 for detecting existence and non-existence of the paper cassette 2. Other structures are substantially the same as those in the first embodiment.

The block diagram of the control system of the image forming apparatus according to the third embodiment is substantially the same as that in the second embodiment (see, FIG. 8). Where the paper detection sensors detecting that the paper jamming occurs are any one or more of the two paper introduction sensors S1, S2 and the writing sensor S3 and where either the paper delivery sensor S4 or the reverse conveyance sensor S5 detects the existence of the paper, the controller 100 judges not that paper jamming occurs in the reverse conveyance unit 14 but that the paper is remaining as located on the upstream of the reverse conveyance unit 14. Where the paper introduction sensor S1 detects that the paper exists and where other paper detection sensors (S2 to S8) detect that no paper exists, the controller 100 judges that the jammed paper P2 is remaining in the paper cassette 2.

Where the reverse conveyance sensor S6 disposed in the reverse conveyance unit 14 detects the situation that no paper exists, the controller 100 judges that the front end of the paper P2 remaining on the upstream side of the reverse conveyance unit 14 does not reach the location of the reverse conveyance sensor S6. As a result of this judgment, the controller 100 switches the conveyance switching guide 19 toward the delivery route 20, or an arrow direction in FIG. 11, by the reverse solenoid 108 and the like (see, FIG. 10).

By drive of the roller in the fixing section 11 and the reverse roller 16 in the reverse conveyance unit 14, the paper is fed until that both of the paper delivery sensor S4 and the reverse conveyance sensor S5 detect that no paper exists. Furthermore, the reverse roller 16 and the conveyance roller 23 are driven until that the remaining paper P2 goes by the conveyance roller 23, thereby conveying the remaining paper P2 to the paper cassette 2. The monitor 107 at that time displays that the remaining paper P2 on the upstream side of the reverse conveyance unit 14 of the image forming apparatus is delivered to the paper cassette 2. Where the cassette existence sensor S9 detects that the paper cassette 2 is pulled out, the controller 100 begins remaining printing operation.

As shown in FIG. 12, where the controller 100 judges that the remaining paper P2 exists and where the reverse conveyance sensor S6 in the reverse conveyance unit 14 detects that the paper exists, only the reverse roller 16 in the reverse conveyance unit and the conveyance roller 23 are rotated reverse to convey the paper P2 until the reverse conveyance sensor S6 detects that no paper exists, and the conveyance switching guide 19 is switched toward the delivery route 22 by the solenoid 108. The roller in the fixing section 11 and the reverse roller 16 and the conveyance roller 23 in the reverse conveyance unit 14 are driven to convey the paper until that both of the paper delivery sensor S4 and the reverse conveyance sensor S5 detect that no paper exists, and the reverse roller 16 and the conveyance roller 23 are driven until that the paper P2 goes by the conveyance roller 23, thereby conveying the paper P2 to the paper cassette 2 (see, FIG. 13). In this situation, the paper P2 remaining in the image forming apparatus is also delivered to the paper cassette 2 via the delivery route 22 from the reverse conveyance unit 14 according to the conveyance switching guide 19.

With the structure of the third embodiment, by proving conveyance switching guide 19 in the reverse conveyance unit 14, as well as by providing the conveyance route 22 for conveying the paper to the paper cassette 2, the stopped paper is conveyed into the reverse conveyance unit 14 when the paper located on the upstream side of the reverse conveyance unit 14 is stopped astride the apparatus body 1 and the reverse conveyance unit 14 during occurrences of paper jamming, and is delivered and to contained in the paper cassette 2, so that it is advantageous that the necessary space can be made smaller for installing the image forming apparatus.

Figure 14:
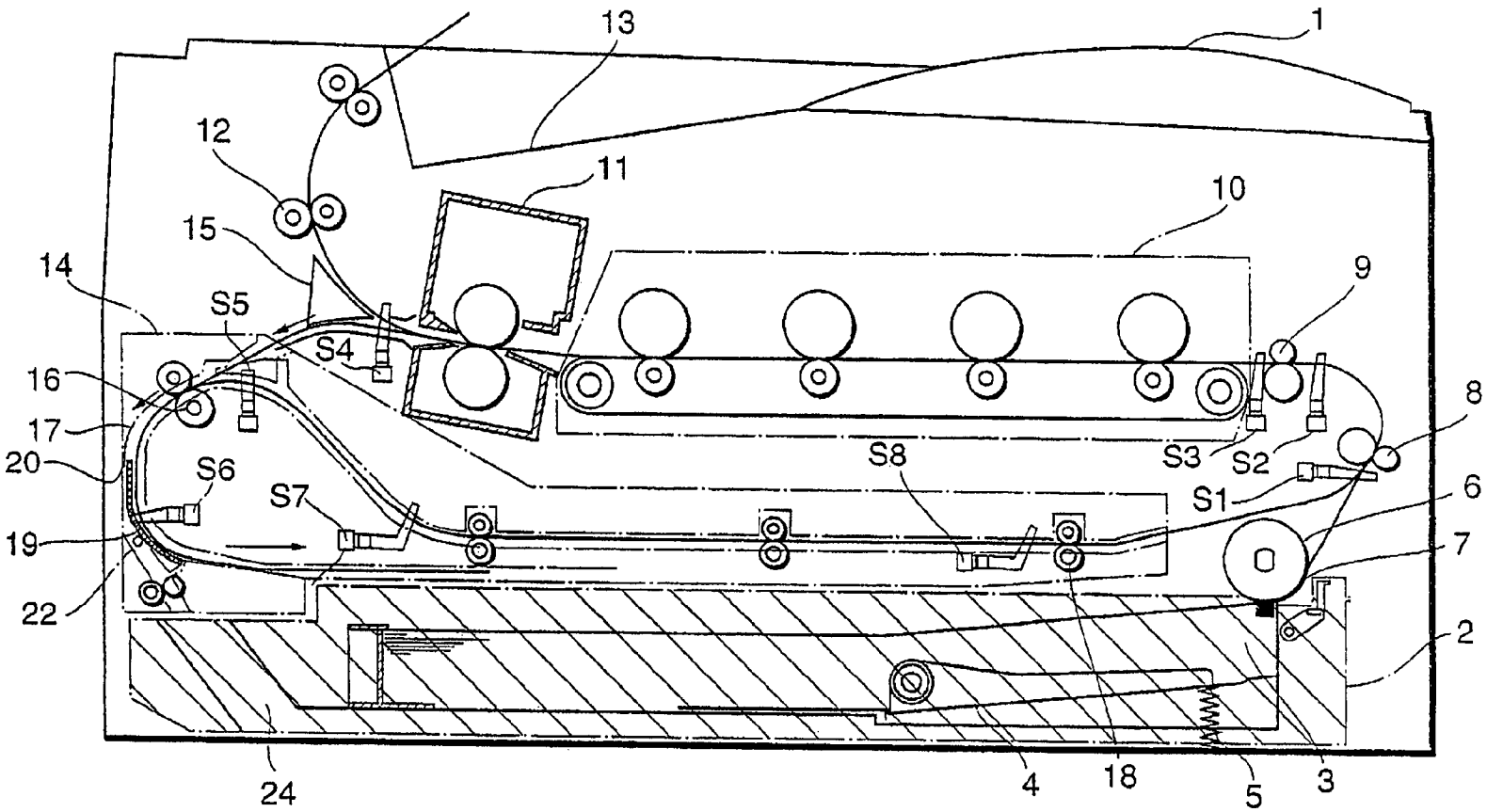
FIG. 14 is a cross-sectional diagram showing a structure of an image forming apparatus according to the fourth embodiment of the invention.
Figure 15:
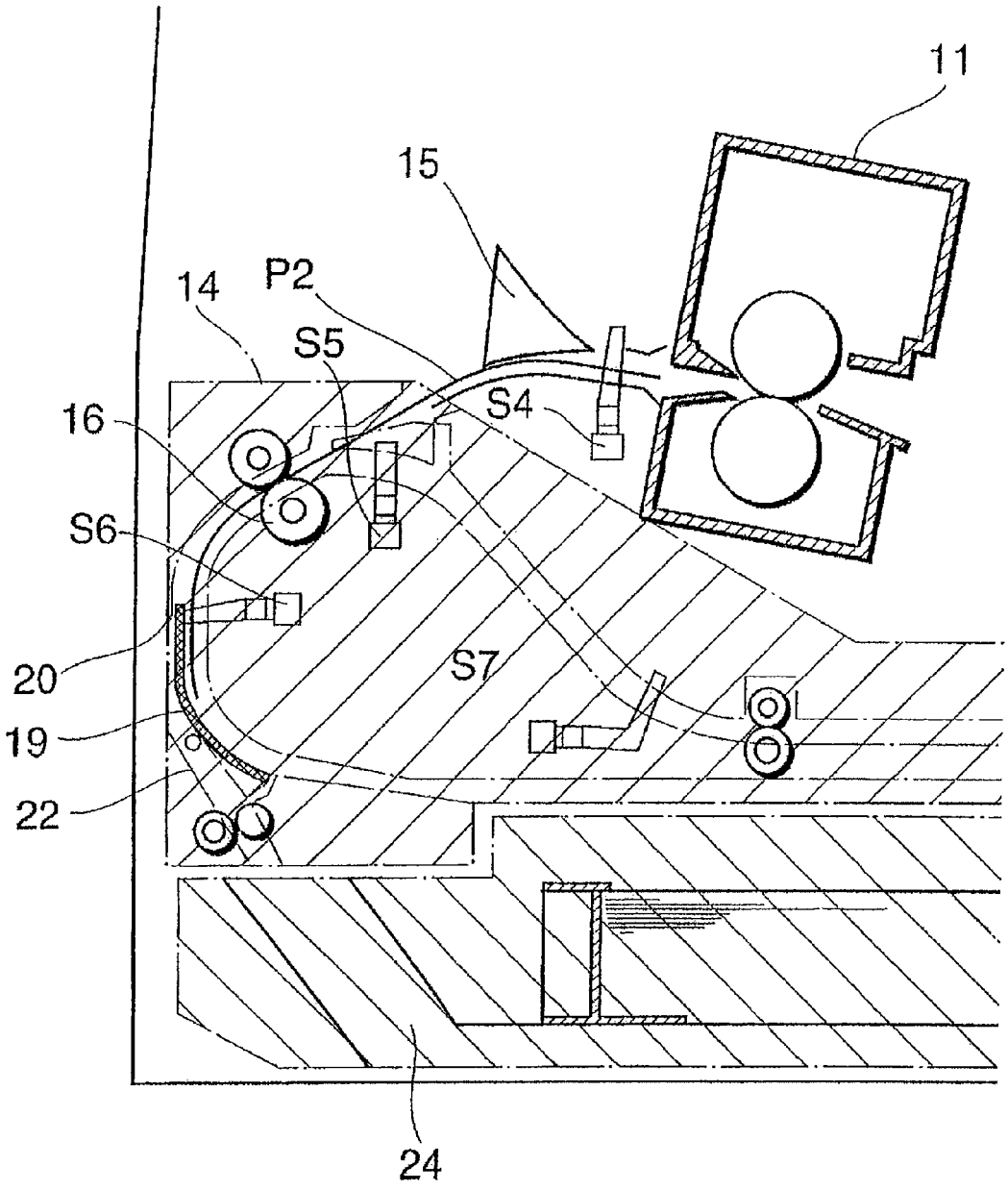
FIG. 15 is an illustration showing an essential portion of the image forming apparatus according to the fourth embodiment.
Figure 16:
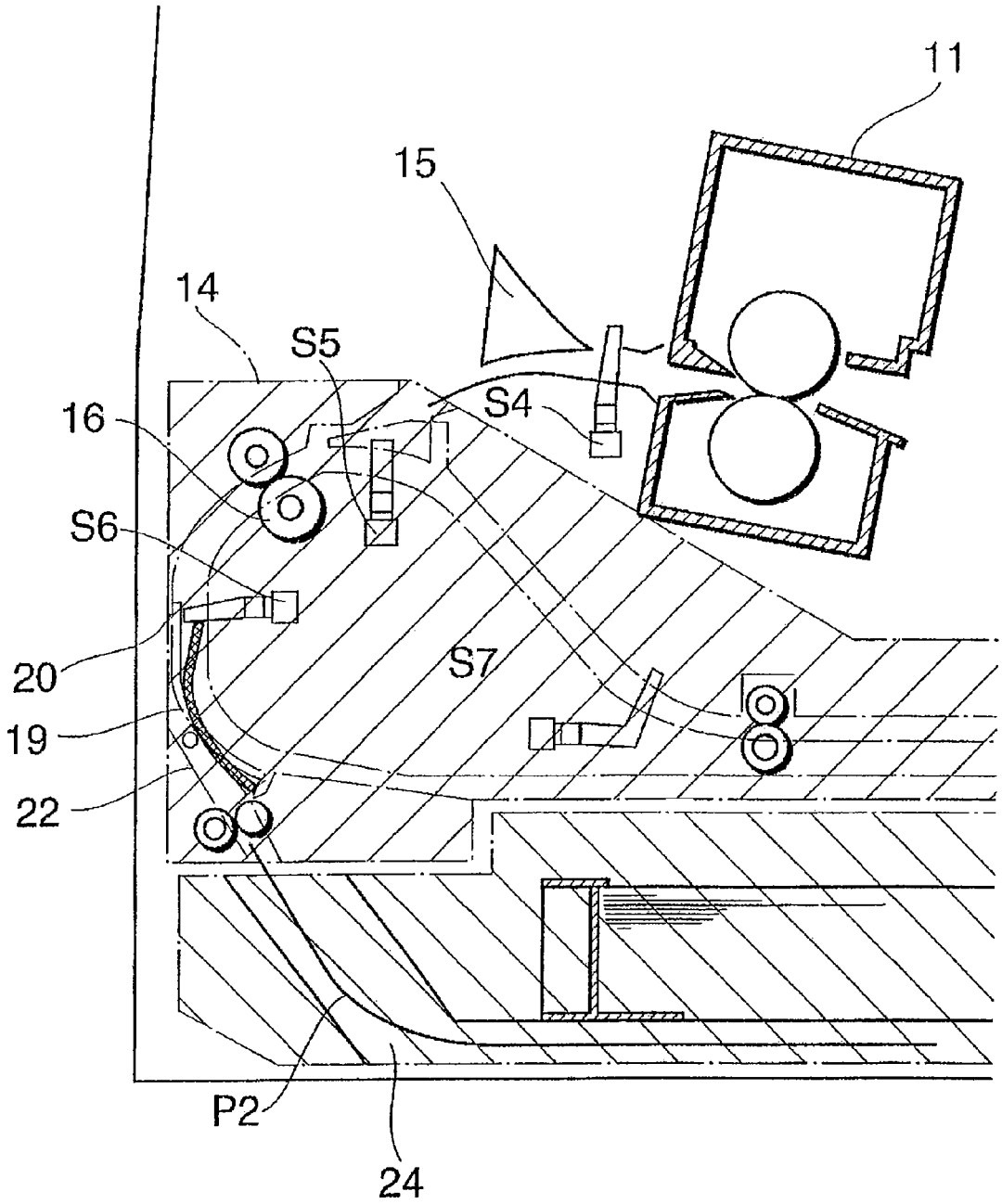
FIG. 16 is an illustration showing the essential portion of the image forming apparatus according to the fourth embodiment.

Referring to FIG. 14 to FIG. 16, an image forming apparatus according to the fourth embodiment of the invention is described in detail. FIG. 14 is a cross-sectional diagram showing a structure of an image forming apparatus according to the fourth embodiment of the invention. As shown in FIG. 14, in the image forming apparatus according to the fourth embodiment, the paper cassette 2 is formed with a paper conveyance route 24 other than the plural paper containers. Other structures are substantially the same as those in the third embodiment.

The operation up to that the paper P2 stopping and remaining astride the apparatus body 1 and the reverse conveyance unit 14 is conveyed to the interior of the paper cassette 2, during occurrences of paper jamming, is substantially the same as those in the third embodiment. The remaining paper P2 conveyed to the paper cassette 2 is contained in another container, which is different from a container for containing paper not yet subject to printing.

With the structure of the fourth embodiment of the invention, where the operator re-enter the paper cassette 2 as leaving the remaining paper introduced in the paper cassette as it is, the feeding roller 6 prevents the remaining paper from being fed to the image forming apparatus again.

It is to be noted that although in the above embodiments exemplified as the medium is a paper, the medium can be made of any material capable of being printed, e.g., plastic film sheet, metal foil, etc.

It is to be noted that this invention is not limited to these above described embodiments but can be variously modified based on the purpose of this invention, and these modifications are not excluded from the scope of this invention.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. An image forming apparatus for forming an image on a medium, comprising:

an apparatus body, including a first medium discharge section, a medium feeding unit forming a part of a medium conveyance route, the medium feeding unit being detachably attached to the apparatus body, said medium feeding unit including a second medium discharge section which discharges a medium directly through an opening of the apparatus body, and a controller which judges whether a paper jam has occurred based on an output of at least one paper sensor, wherein if the paper jam occurs at other than the medium feeding unit, a medium upstream from the medium feeding unit continues to advance into the medium feeding unit and is discharged out of the medium conveyance route via the second medium discharge section, and wherein the second medium discharge section is disposed adjacent to a side surface of the apparatus body of the image forming apparatus.

2. The image forming apparatus according to claim 1, wherein the medium feeding unit is a reverse conveyance unit which conveys the medium upon reversing the side of the medium when images are printed on the double sides of the medium.

3. The image forming apparatus according to claim 1, wherein the first medium discharge section discharges the medium out of the apparatus body when the jam does not occur.

4. The image forming apparatus according to claim 1, wherein the first medium discharge section is disposed on an upper portion of the apparatus body of the image forming apparatus.

5. An image forming apparatus for forming an image on a medium, comprising:

an apparatus body, including a first medium discharge section, a medium feeding unit forming a part of a medium conveyance route, the medium feeding unit being detachably attached to the apparatus body, said medium feeding unit including a second medium discharge section, and a controller which judges whether a paper jam has occurred based on an output of at least one paper sensor, wherein, in accordance with the paper jam occurring at other than the medium feeding unit, a medium upstream from the medium feeding unit continues to advance into the medium feeding unit and is discharged out of the medium conveyance route via the second medium discharge section to a medium stack area inside the apparatus where the medium remains until removed by a user, the discharged medium from the second medium discharge section being deposited in the medium stack area without nipping and holding by any rollers other than a pair of rollers disposed in the second medium discharge section.

6. The image forming apparatus according to claim 5, wherein the medium stack area is disposed on a medium cassette holding an unprinted medium.

7. The image forming apparatus according to claim 5, wherein the medium stack area is a stack area formed in a medium cassette holding an unprinted medium.

8. The image forming apparatus according to claim 5, wherein the medium stack area is disposed below and proximate to a medium cassette holding an unprinted medium.

* * * * *